United States Patent [19]

Freeman

[11] 4,339,900

[45] Jul. 20, 1982

[54] SKY-LIGHT STRUCTURE HAVING A FLEXIBLE-TUBE SHAFT

[76] Inventor: William T. Freeman, RR-4, Springfield, Ill. 62707

[21] Appl. No.: 191,380

[22] Filed: Sep. 29, 1980

[51] Int. Cl.[3] ..... E04B 7/18; E04D 13/03

[52] U.S. Cl. ..... 52/200; 52/22

[58] Field of Search ..... 52/22, 173, 173 DS, 52/72, 200; D23/153; 405/194

[56] References Cited

U.S. PATENT DOCUMENTS

| | | | |
|---|---|---|---|
| 230,952 | 8/1880 | Mark | 52/200 |
| 683,984 | 10/1901 | Reiss | 52/72 X |
| 1,016,808 | 2/1912 | Williamson | 405/194 |
| 1,547,916 | 7/1925 | Hoffman | 52/200 |
| 1,866,438 | 7/1932 | Williamson | 405/194 |
| 3,012,375 | 12/1961 | Wasserman | 52/22 |
| 3,216,161 | 11/1965 | Forsman | 52/200 |
| 3,338,006 | 8/1967 | Belden | 52/200 |

FOREIGN PATENT DOCUMENTS

| | | | |
|---|---|---|---|
| 487462 | 12/1929 | Fed. Rep. of Germany | 135/1 R |
| 2555201 | 6/1977 | Fed. Rep. of Germany | 52/173 DS |

*Primary Examiner*—J. Karl Bell

*Attorney, Agent, or Firm*—Ralph F. Staubly

[57] ABSTRACT

Instead of enclosing the space between a sky-light dome and a ceiling window by the usual custom-built box or shaft, the space is easily, economically and effectively enclosed by a section of large-diameter flexible tubing stretched between the dome and the window. The ends of the tubing section fit over short sleeves on or attached to the dome and the window, and can be fastened to the sleeves by cement and/or constrictable bands. The tubing is preferably formed of an outer plastic ply and an inner light-reflective aluminum-foil or an aluminized-plastic ply, which are adhesively laminated with a helically coiled spring-wire skeleton embedded therebetween.

10 Claims, 4 Drawing Figures

SKY-LIGHT STRUCTURE HAVING A FLEXIBLE-TUBE SHAFT

BACKGROUND AND OBJECTS OF THE INVENTION

The usual home-type sky-light dome unit is paired with a ceiling window positioned below the dome, and spaced therefrom a few feet (the height of the attic or under-roof airspace). The space between the sky-light dome and the ceiling window is usually enclosed by a custom-built (and thus expensive) box or shaft, which is needed for thermal insulation and for excluding insects and dust. It is the principal object of this invention to provide a simple, inexpensive, easily installed, yet highly effective sky-light shaft formed of a section of a flexible tubing. Other objects and advantages will appear as the following detailed description proceeds.

BRIEF DESCRIPTIONS OF THE DRAWING FIGURES

DETAILED DESCRIPTION

Figure 1:
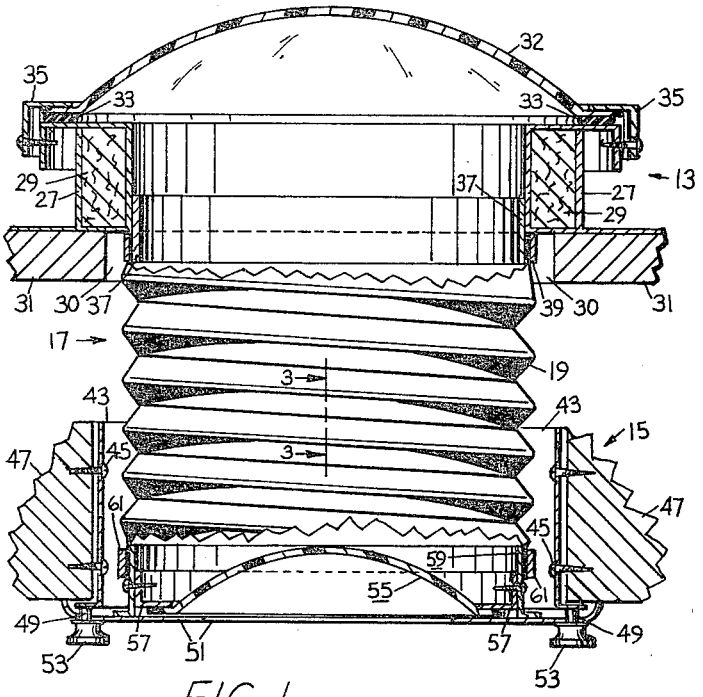
FIG. 1 is an elevational view in vertical axial section of a preferred embodiment of the invention.
Figure 2:
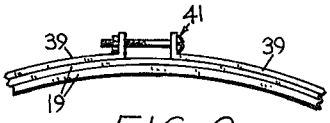
FIG. 2 is a fragmentary enlarged plan view of the tightening elements of a draw-band.
Figure 3:
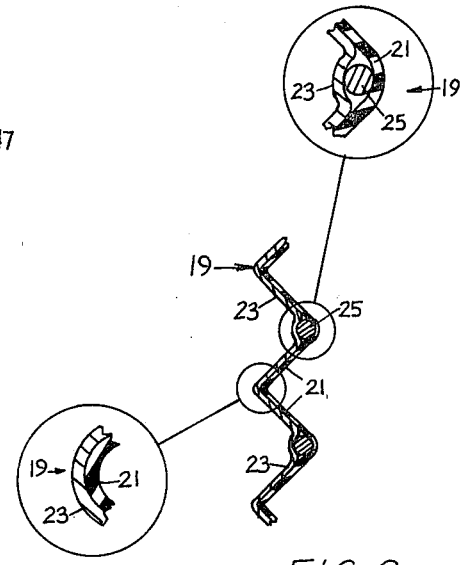
FIG. 3 is an enlarged fragmentary elevational view of the plastic flexible tube in section taken on the line 3—3 of FIG. 1.

With reference now to FIGS. 1–3 of the drawings, the numeral 11 generally designates a preferred embodiment of the invention which comprises basically a roof dome unit 13, a ceiling window 15 and a flexible-tube shaft 17. For the most part, the dome unit 13 and the window 15 are of generally conventional constructions.

The shaft 17 comprises a section 19 of a flexible tube which is manufactured initially cylindrical but which could be shaped oval or rectangular on the job or previously. The tube is preferably formed of two plies (FIG. 3). The outer ply 21 is shown as being of plastic material, while the inner ply 23 is shown as being a metal foil (e.g. aluminum) but which could also be plastic with its inner surface made highly light-reflective as by being aluminized in known manner. The outer ply 21, if desired, can likewise be metallic.

It is also preferred that the tube should have incorporated therein a helically coiled spring wire 25 to keep it radially expanded and to cause it to expand and contract evenly axially in accordion-manner. The wire 25 desirably lies between the two plies 21 and 23 as shown in the upper circle of FIG. 3, but could lie on the inner surface of the tube section 19, which could then be of single-ply construction for economy.

The dome unit 13 (FIG. 1) comprises a hollow sheet-metal ring 27 filled with insulating material 29. The ring 27 rests on the edge of an opening 30 in a roof slab 31. A transparent or translucent acrylic dome 32 has its marginal flange sealed by a rubber-like gasket 33 against a peripheral flange on the ring 27 and is clamped thereto by an inwardly flanged ring 35. The ring 27 has welded therein a short cylindrical sleeve 37 which extends downwardly sufficiently to receive snugly thereover the upper end of the tube section 19. The tube-section end is cemented to the sleeve 37, and/or is fixed thereto by a draw-band 39 (FIGS. 1 and 2) of known construction, including out-turned ends pulled together by a nut-and-bolt pair 41.

The ceiling window 15 comprises a sheet-metal sleeve 43 fastened by screws 45 in a hole cut into the ceiling panel 47. The sleeve 43 has an out-turned flange from which screws 49 extend downwardly through apertures in a ceiling-dome frame 51. The frame 51 is fixed to screws 49 by knurled nuts 53. The frame 51 supports the transparent or translucent acrylic dome 55 which is clamped thereagainst by screw-fastened angle-clips 57. The frame 51 has welded to its upper surface a sleeve 59 over which the lower end of the plastic tube section 19 snugly fits to be fastened thereto by cement and/or another draw-band 61 similar to or identical with the draw-band 39 previously described. Due to the axial elasticity and compressibility of the tube section 19, its attachment to the sleeve 59 can be made well below the ceiling level (e.g. by one foot) before the frame 51 is fastened to the sleeve 43.

Figure 4:
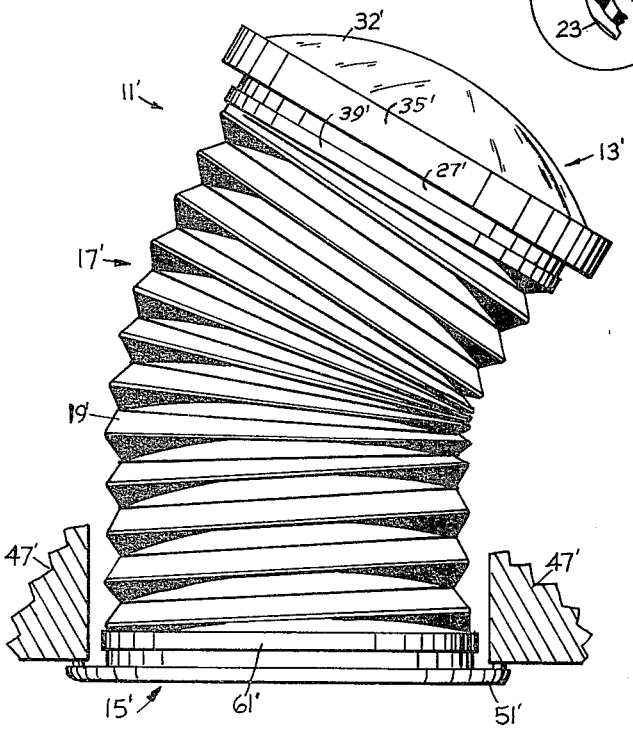
FIG. 4 is a largely schematic elevational view (similar to FIG. 1) showing the invention applied to a sky-light in a sloped roof.

FIG. 4 shows how the invention can be applied to a slanted-roof installation. In this figure the parts corresponding to like parts in FIG. 1 are designated by the same numerals but with prime symbols added.

The invention having been described, what is claimed is:

1. In a skylight installation having a roof-installed closure for a light-transmitting opening therein, and a ceiling-installed light-transmitting window, the improvement comprising: a flexible-walled tube enclosing the space between said closure and said window to provide light-channeling through, thermal insulation for, and dust- and insect-exclusion from, said space.

2. The invention according to claim 1 wherein said flexible-walled tube has a highly light-reflective inner surface.

3. The invention according to claim 1 wherein said flexible-walled tube has a coil spring fixed thereto to prevent transverse collapsing thereof and to permit accordion-like expansion, contraction and/or bending thereof.

4. The invention according to claim 1 wherein at least one end of said tube is anchored to a sleeve attached to at least one of said closure and said window.

5. The invention according to claim 4 wherein said end of said tube telescopes over said sleeve and is fastened thereto by cement.

6. The invention according to claim 5 wherein a draw-band is applied over said sleeve and is tightened before said cement sets.

7. The invention according to claim 4 wherein a draw-band is constricted over said end of said tube to anchor it to said sleeve.

8. The invention according to claim 1 wherein said tube comprises at least two plies cohesively joined and a coil spring is embedded therebetween.

9. The invention according to claim 8 wherein at least one of said plies is metallic.

10. The invention according to claim 8 wherein at least one of said plies is formed of a flexible plastic material.

* * * * *